US010709163B2

(12) United States Patent
Klipfel et al.

(10) Patent No.: US 10,709,163 B2
(45) Date of Patent: Jul. 14, 2020

(54) METHOD FOR THE PREPARATION OF A CAST SHEET OF HOMOGENIZED TOBACCO MATERIAL

(71) Applicant: PHILIP MORRIS PRODUCTS S.A., Neuchatel (CH)

(72) Inventors: Yorick Klipfel, St-Saphorin-sur-Morges (CH); Frederic Ulysse Buehler, Neuchatel (CH); Marc Perrinjaquet, Chez-le-Bart (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 16/097,861

(22) PCT Filed: Apr. 10, 2017

(86) PCT No.: PCT/EP2017/058581

§ 371 (c)(1),
(2) Date: Oct. 31, 2018

(87) PCT Pub. No.: WO2017/202538

PCT Pub. Date: Nov. 30, 2017

(65) Prior Publication Data

US 2019/0142058 A1 May 16, 2019

(30) Foreign Application Priority Data

May 27, 2016 (EP) ..... 16171642

(51) Int. Cl.
*A24B 3/14* (2006.01)
*A24B 15/14* (2006.01)

(52) U.S. Cl.
CPC ..... *A24B 3/14* (2013.01); *A24B 15/14* (2013.01)

(58) Field of Classification Search
CPC ..... A24B 3/14; A24B 15/14
(Continued)

(56) References Cited

U.S. PATENT DOCUMENTS 2,734,513 A 2/1956 Hungerford
3,840,024 A 10/1974 Nicholl
(Continued)

FOREIGN PATENT DOCUMENTS

CN 103892438 7/2014
CN 203776026 8/2014
(Continued)

OTHER PUBLICATIONS

PCT Search Report and Written Opinion for PCT/EP2017/058581 dated Jul. 17, 2017 (11 pages).
(Continued)

*Primary Examiner* — Eric Yaary
(74) *Attorney, Agent, or Firm* — Mueting Raasch Group

(57) ABSTRACT

The present invention relates to a method for the preparation of a cast sheet of homogenized tobacco material, said method comprising: •pulping (108) cellulose fibres (5) with water (6); •grinding (102, 106) a blend of tobacco of one or more tobacco types to tobacco particles (10); •combining (107) the pulped cellulose fibres with the tobacco particles and with a binder (8) to form a slurry; •homogenizing the slurry; •casting (110) the slurry to form a cast sheet of homogenized tobacco material from the slurry; •discarding (112) undesired portions of the cast sheet; and •introducing (113) the discarded undesired portions (9) of the cast sheet into the slurry.

26 Claims, 6 Drawing Sheets

(58) Field of Classification Search
USPC ..... 162/191
See application file for complete search history.

(56) References Cited

U.S. PATENT DOCUMENTS

| | | | | |
|---|---|---|---|---|
| 4,306,578 | A * | 12/1981 | Schmidt | A24B 15/30 131/353 |
| 6,464,830 | B1 * | 10/2002 | Holz | D21F 1/02 162/130 |
| 2005/0039767 | A1 * | 2/2005 | Mua | A24B 3/14 131/370 |
| 2007/0025904 | A1 * | 2/2007 | Skuse | C01F 11/18 423/430 |
| 2009/0095313 | A1 * | 4/2009 | Fuisz | A24B 3/18 131/290 |

FOREIGN PATENT DOCUMENTS

| | | |
|---|---|---|
| WO | 2016/050470 | 4/2016 |
| WO | WO 2016/050471 | 4/2016 |
| WO | WO 2016/067226 | 5/2016 |

OTHER PUBLICATIONS

Office Action issued in China for Application No. 201780026879.9 dated Apr. 19, 2019 (16 pages). English translation included.
Office Action issued in China for Application No. 201780026879.9 dated Jul. 23, 2019 (7 pages).

* cited by examiner 302
304
301
303
300

METHOD FOR THE PREPARATION OF A CAST SHEET OF HOMOGENIZED TOBACCO MATERIAL

This application is a U.S. National Stage Application of International Application No. PCT/EP2017/058581 filed Apr. 10, 2017, which was published in English on Nov. 30, 2017, as International Publication No. WO 2017/202538 A1. International Application No. PCT/EP2017/058581 claims priority to European Application No. 16171642.8 filed May 27, 2016.

The invention is related to a method for preparation of a cast sheet of homogenised tobacco material.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf. The process to form homogenized tobacco material sheets commonly comprises a step in which ground tobacco and a binder are mixed to form a slurry. The slurry is then used to create a tobacco web, for example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs or sheets may be cut in a similar fashion as whole leaf tobacco to produce tobacco cut filler suitable for cigarettes and other smoking articles.

However, such way to create homogenized tobacco sheets or cast leaves may generate a relatively large amount waste material.

Some of this waste material may be created due to the formation of defects in the cast leaf during the casting or drying processes, conducting to reject portions of cast leaf where the defects are present.

Other waste material may be created at the beginning of the production, when the grammage of the cast leaf is adjusted, so as to reach a pre-determined cast leaves grammage suitable for the aerosol-generating article. Commonly, the first portion of the cast leaf at the beginning of the casting process does not have the desired grammage and it is therefore discarded.

Other waste material may be also generated when preparing bobbins in which the cast leaf is wound. Commonly the width of the cast leaf is not an exact multiple of the width of the bobbin and therefore there might be some extra width in the cast tobacco leaf which needs to be trimmed, for instance on the lateral sides of the master bobbins, to fit the bobbins' width.

The above mentioned tobacco cast leaves waste material may represent, depending on the circumstances, from about 3 percent to up to about 20 percent of the total manufactured cast leaves. Having the cast leaf preferably a high content of tobacco, this waste material contains a high percentage of a relatively "expensive" component, so that this generated waste represents not only a loss of production due to the large amount of non-used material, but also a non-negligible waste of money.

Further, in aerosol-generating articles, the tobacco present in the homogenized tobacco material is typically the only tobacco, or includes the majority of the tobacco, present in the aerosol-generating article. This means that the aerosol composition that is generated by such an aerosol-generating article is substantially only based on the homogenized tobacco material. It is thus important to have good control over the composition of the homogenized tobacco material, for the control for example, of the taste of the aerosol.

There is therefore a need for a new method for preparing a cast sheet of homogenized tobacco material for the use in an aerosol-generating article where the amount of waste is minimized and at the same time a good control of the cast sheet production is maintained.

According to an aspect, the invention relates to a method for the preparation of a cast sheet of homogenized tobacco material, said method comprising: pulping cellulose fibres with water; grinding a blend of tobacco of one or more tobacco types to tobacco particles; combining the pulped cellulose fibres with the tobacco particles and with a binder to form a slurry; homogenizing the slurry; casting the slurry to form a cast sheet of homogenized tobacco material from the slurry; discarding undesired portions of the cast sheet; and introducing the discarded undesired portions of the cast sheet into the slurry.

According to the invention, cast sheet portions which are in the prior art considered as waste material and discarded, are now reused in the formation of a new slurry. The slurry preparation thus includes a step in which the discarded cast sheet is reintroduced into the slurry, added with the other ingredients, so that in can be homogenized with the rest of the slurry ingredients to be part of a new cast sheet. The fact that the discarded cast sheet may present defects, such as a non-optimal grammage, does not prevent its re-use, because the undesired portions of cast sheet which are discarded becomes again slurry during the homogenization and therefore the defects are vanishing, or in any case they do not hinder the formation of a new cast sheet.

The term "homogenized tobacco material" is used throughout the specification to encompass any tobacco material formed by the agglomeration of particles of tobacco material. Sheets or webs of homogenized tobacco are formed in the present invention by agglomerating particulate tobacco obtained by grinding or otherwise powdering for example tobacco leaf lamina or tobacco leaf stems or blends thereof.

In addition, homogenized tobacco material may comprise a minor quantity of one or more of tobacco dust, tobacco fines, and other particulate tobacco by-products formed during the treating, handling and shipping of tobacco.

The slurry may comprise a number of different components or ingredients. These components influence the homogenized tobacco material properties. A first ingredient is a tobacco powder blend, which preferably contains the majority of the tobacco present in the slurry. The tobacco powder blend is the source of the majority of tobacco in the homogenized tobacco material and thus gives the flavor to the final product, for example to an aerosol produced by heating the homogenized tobacco material. In the present invention, the tobacco powder introduced in the slurry is preferably formed by tobacco lamina and stem of different tobacco types, which are properly blended. In this, the term "tobacco type" refers to one of the different varieties of tobacco, in three main groups of bright tobacco, dark tobacco and aromatic tobacco.

A cellulose pulp containing cellulose fibers is preferably added to the slurry in order to increase the tensile strength of the tobacco material web, acting as a strengthening agent. A binder and an aerosol-former are preferably added as well, in order to enhance the tensile properties of the homogenized sheet and promote the formation of aerosol. Further, in order to reach a certain viscosity and moisture optimal for casting the web of homogenized tobacco material, water may be added to the slurry. The slurry is mixed in order to render it as homogeneous as possible.

Preferably, the blending of the different tobacco types is performed after the grinding. The different tobacco types are selected according to the invention in order to obtain the desired blend. Preferably, the grinding of the tobacco types is performed in two steps, a first coarse grinding step followed by a fine grinding step. Advantageously, the step of blending follows the step of coarse grinding. At this stage handling of the coarsely ground tobacco material is still easy. At the same time, this allows inline blending at a single production facility. Further, an intermediate boxing and storing process of blended tobacco leafs or strips is not required. Advantageously, the selected tobaccos for the tobacco powder can be delivered in standard shipping crates for tobacco leafs to the facility in which the coarse ground tobacco particles are manufactured. At the exit of the facility in which the coarse ground tobacco particles are manufactured, the coarsely ground tobacco particles can be transported inline to the fine grinding and casting machinery. The coarsely ground tobacco particles may be packed and shipped to the facility with the fine grinding and casting machinery. Preferably, the fine grinding and casting machinery are at the same location due to the physical properties of the tobacco powder after the fine grinding (for example due to the destruction of the protective cell structure of the tobacco that leads to the release of intrinsic binders).

The cellulose pulp, the tobacco particles forming a blend and the binder are added together and thus homogenized, for example by mixing, so that a homogeneous slurry is produced.

The slurry is then cast in order to form a cast sheet, alternatively also called cast leaf, of homogenized tobacco material. The cast sheet is then preferably further treated or processed in order to be a component, for example, of an aerosol-generating article, where it is heated in order to produce an aerosol. For example, these further processing or treatment steps may include any of: a drying step, a winding step, a cutting step, a crimping step or others.

In any of the steps of realization of the homogenized tobacco cast sheet, portions of the sheet itself may be selected in order to be disregarded. These portions which are preferably disregarded may be for example defective portions, that is, portions that include one or more defect or are outside the desired specifications, such as for example portions of the sheet which includes slurry agglomerates, draggers, or parts of the sheet that does not have the desired thickness or uniformity. Further, these cast sheet portions which are disregarded may fulfil the desired specifications, but are in excess, for example are exceeding the size of the bobbin where the cast sheet is to be wound, so that they need to be trimmed. All cast sheet portions to be discarded, either defective or in excess or anyhow removed from the cast sheet for any reason during or after the production process, are called in the following "undesired portions" of the cast sheet.

These portions are removed from the rest of the cast sheet in order to be discarded. In the prior art, these portions represent part of the waste material generated during the process of production of the cast sheet.

According to the invention, these portions are reintroduced inside the slurry. For example, if the slurry is prepared inside a tank, the undesired portions are introduced inside the tank to be part again of a slurry to be cast into a new cast sheet. The undesired portions are preferably dissolved inside the rest of the slurry so that the slurry including the undesired portions is homogeneous. In this way, the material forming the undesired portions of cast sheet is not wasted, but reused in the formation of a further cast sheet.

According to a further aspect, the invention relates to a method for the preparation of a cast sheet of homogenized tobacco material, said method comprising forming a first batch of slurry, said formation comprising: pulping cellulose fibres with water; grinding a blend of tobacco of one or more tobacco types to tobacco particles; combining the pulped cellulose fibres with the tobacco particles and with a binder to form a slurry; homogenizing the slurry. Further the method also includes: casting the slurry to form a cast sheet of homogenized tobacco material from the slurry; discarding undesired portions of the cast sheet; and forming a second batch of slurry. The second formation comprises: pulping cellulose fibres with water; grinding a blend of tobacco of one or more tobacco types to tobacco particles; combining the pulped cellulose fibres with the tobacco particles and with a binder to form a slurry; homogenizing the slurry; and introducing the discarded undesired portions of the cast sheet into the slurry.

As in the previous aspect, a slurry is formed by the combination of several ingredients, it is homogenised and then casted. The undesired portions of cast sheet are thus removed. These portions are re-used in an additional subsequent production of a batch of slurry. In this way, in each subsequent production of slurry, some undesired portions of cast sheet produced using one or more of the previous batches of slurry are introduced to form a new cast sheet. The slurry is preferably produced in batches so that its formulation can be properly controlled.

Preferably, the step of introducing the discarded undesired portions of the cast sheet into the slurry takes place before combining the pulped cellulose fibres with the tobacco particles. It is advantageous to add back into the slurry, or into one of the next slurry batches, the discarded undesired portions of cast sheet before the tobacco particles are introduced in the slurry, because the slurry before the tobacco introduction is more fluid and therefore the dissolution of the undesired portions of cast sheet in the slurry is relatively fast and efficient. If the undesired portions of cast sheet are added into the slurry after the tobacco particles, the process of homogenization of the slurry can still take place satisfactorily, however it is probably longer due to the higher viscosity of the slurry and possibly sub-optimal, that is, some parts of the discarded portions may not homogenize.

More preferably, the method includes mixing the discarded undesired portions of cast sheet with the pulped cellulose fibres before the step of combining the tobacco particles with the pulped cellulose fibres. In this way, before the addition of the tobacco particles, the undesired portions of cast sheet are substantially dissolved inside the slurry and the addition of the tobacco particles takes place when the slurry is homogeneous. The increase of viscosity due to the addition of the tobacco particles therefore does not hinder the quality of the slurry itself. Preferably, the mixing last for at least between about 5 minutes to about 10 minutes before the introduction of tobacco particles into the slurry.

Advantageously, most of the undesired tobacco portions of the cast sheet, that is, at least about 70 percent of the total amount of undesired tobacco portions which is added in a single slurry batch, is added to the slurry when the amount of tobacco particle blend is rather low, that is, preferably below about 10 percent.

Preferably, the method includes the steps of: selecting a total amount of tobacco to be present in the slurry in dry weight; determining an amount of tobacco in dry weight present in the discarded undesired portions of the cast sheet introduced in the slurry; and adding an amount of tobacco particles to the slurry in order to reach said selected total amount of tobacco in the slurry when summed to the amount of tobacco present in the discarded undesired portions of the cast sheet already introduced in the slurry. The slurry includes preferably a pre-determined amount of each ingredients, depending on the characteristics of the desired cast sheet or on the desired organoleptic properties of the aerosol that can be produced heating the homogenized tobacco sheet, for example in an aerosol-generating article. Therefore, the amount of tobacco particles in dry weight introduced in a slurry batch is controlled so that it is within a predefined range depending on the desired cast sheet. If the same amount of tobacco particles would be added to the slurry as in a production of a batch without the addition of the discarded undesired cast sheet portions, a tobacco amount outside the specified range would be obtained. It is therefore preferred to calculate the quantity of tobacco already present in the slurry due to the introduction of the undesired portion of cast sheet and then subtract it from the total amount of tobacco particles to be added to the slurry, so that the total amount of tobacco is present into the slurry.

Preferably, the method includes the step of blending one or more the following tobaccos types: Bright tobacco; Dark tobacco; Aromatic tobacco; Filler tobacco; to obtain the blend of tobacco of one or more tobacco types. With the term "tobacco type" one of the different varieties of tobacco is meant. With respect to the present invention, these different tobacco types are distinguished in three main groups of bright tobacco, dark tobacco and aromatic tobacco. The distinction between these three groups is based on the curing process the tobacco undergoes before it is further processed in a tobacco product.

Bright tobaccos are tobaccos with a generally large, light coloured leaves. Throughout the specification, the term "bright tobacco" is used for tobaccos that have been flue cured. Examples for bright tobaccos are Chinese Flue-Cured, Flue-Cured Brazil, US Flue-Cured such as Virginia tobacco, Indian Flue-Cured, Flue-Cured from Tanzania or other African Flue Cured. Bright tobacco is characterized by a high sugar to nitrogen ratio. From a sensorial perspective, bright tobacco is a tobacco type which, after curing, is associated with a spicy and lively sensation. According to the invention, bright tobaccos may be tobaccos with a content of reducing sugars of between about 2.5 percent and about 20 percent of dry weight base of the leaf and a total ammonia content of less than about 0.12 percent of dry weight base of the leaf. Reducing sugars comprise for example glucose or fructose. Total ammonia comprises for example ammonia and ammonia salts.

Dark tobaccos are tobaccos with a generally large, dark coloured leaves. Throughout the specification, the term "dark tobacco" is used for tobaccos that have been air cured. Additionally, dark tobaccos may be fermented. Tobaccos that are used mainly for chewing, snuff, cigar, and pipe blends are also included in this category. From a sensorial perspective, dark tobacco is a tobacco type which, after curing, is associated with a smoky, dark cigar type sensation. Dark tobacco is characterized by a low sugar to nitrogen ratio. Examples for dark tobacco are Burley Malawi or other African Burley, Dark Cured Brazil Galpao, Sun Cured or Air Cured Indonesian Kasturi. According to the invention, dark tobaccos are tobaccos with a content of reducing sugars of less than about 5 percent of dry weight base of the leaf and a total ammonia content of up to about 0.5 percent of dry weight base of the leaf.

Aromatic tobaccos are tobaccos that often have small, light coloured leaves. Throughout the specification, the term "aromatic tobacco" is used for other tobaccos that have a high aromatic content, for example a high content of essential oils. From a sensorial perspective, aromatic tobacco is a tobacco type which, after curing, is associated with spicy and aromatic sensation. Example for aromatic tobaccos are Greek Oriental, Oriental Turkey, semi-oriental tobacco but also Fire Cured, US Burley, such as Perique, Rustica, US Burley or Meriland.

Additionally, a blend may comprise so called filler tobaccos. Filler tobacco is not a specific tobacco type, but it includes tobacco types which are mostly used to complement the other tobacco types used in the blend and do not bring a specific characteristic aroma direction to the final product. Examples for filler tobaccos are stems, midrib or stalks of other tobacco types. A specific example may be flue cured stems of Flue Cured Brazil lower stalk.

Within each type of tobaccos, the tobacco leaves are further graded for example with respect to origin, position in the plant, colour, surface texture, size and shape. These and other characteristics of the tobacco leaves are used to form a tobacco blend. A blend of tobacco is a mixture of tobaccos belonging to the same or different types such that the tobacco blend has an agglomerated specific characteristic. This characteristic can be for example a unique taste or a specific aerosol composition when heated or burned. A blend comprises specific tobacco types and grades in a given proportion one with respect to the other.

According to the invention, different grades within the same tobacco type may be cross-blended to reduce the variability of each blend component.

Preferably, the method of the invention comprises the steps of: combining the binder with an aerosol-former; and adding the combination to the slurry. Pre-mixing the binder and the aerosol-former before mixing the rest of the slurry has the advantage that otherwise, the binder may gel when it is put in contact with water. The gelling may lead to an unintended non-uniform mixing of a slurry used to produce the homogenized tobacco material. To avoid or postpone as much as possible this gelation, it is preferred that the binder and the aerosol-former are mixed together before the introduction of any other compound in the slurry so that the binder and the aerosol-former can form a suspension.

Preferably, the method includes the steps of: pulping cellulose fibres with water and adding the pulped fibres to a tank; adding the binder to the tank; adding the tobacco particles to the tank; and adding the discarded undesired portions of the cast sheet into the tank before adding the tobacco particles. Preferably, the slurry preparation takes place inside a tank, for example in a tank of a mixer. The tank is dimensioned in order to house the amount of slurry generally formed for a batch.

Preferably, the step of introducing the discarded undesired portions of the cast sheet into the slurry takes place only if the blend of tobacco present in said discarded undesired portions of the cast sheet is the same as the blend of tobacco in said tobacco particles. The homogenized tobacco sheet preferably includes a specific blend of tobacco, that is, a blend of tobacco of different types in specific proportions, as for example in classical smoking articles as in cigarettes. The blend of tobacco types may determine many characteristics of the final product from a sensorial point of view. In order therefore not to alter the proportions of the different tobacco types present in the slurry, that is, in order not to alter the desired blend on a slurry batch, only discarded undesired portions of cast sheet which has been produced using a slurry formed with a given blend is added to a slurry which is formed with the same given blend, so that the ratios or proportions of the different tobacco types remain the same.

Preferably, the method includes the step of: adding the tobacco particles and the discarded undesired portions of the cast sheet into the slurry so as to obtain a total amount of tobacco comprised between about 50 percent and about 93 percent in dry weight basis of slurry. The tobacco present in the homogenized tobacco material may constitute the majority of the tobacco, or even substantially the total amount of tobacco present in the aerosol-generating article. The impact on the characteristics of the aerosol, such as its flavour, may derive predominantly from the homogenized tobacco material.

Preferably, the method comprises the step of: adding in the slurry an amount of undesired portions of cast sheet comprised between about 1 percent and about 25 percent in dry weight basis of the slurry. The amount of undesired portions of cast sheet which is introduced in the slurry can be relatively high because the composition of the portions and of the slurry is preferably the same of that of the slurry, thus, the addition of the discarded portions does not alter the desired characteristics of the new cast tobacco sheet.

Preferably, the method comprises the step of: drying the cast sheet of homogenized tobacco material. A web of homogenized tobacco material is preferably formed by a casting process of the type generally comprising casting a slurry prepared as above described on a support surface. Preferably, the cast web is then dried to form a web of homogenized tobacco material and it is then removed from the support surface. Preferably, the moisture of said homogenized tobacco material web at casting is between about 60 percent and about 80 percent of the total weight of the homogenized tobacco material web at casting. Preferably, the method for production of a homogenized tobacco material comprises the step of drying said homogenized tobacco material, winding said homogenized tobacco material. Preferably the moisture of homogenized tobacco material web after winding is between about 7 percent and about 15 percent of dry weight of the homogenized tobacco material web. Preferably, the moisture of said homogenized tobacco material web at winding is between about 8 percent and about 12 percent of dry weight of the homogenized tobacco material web. Preferably, the method includes adding the binder to the slurry in an amount comprised between about 1 percent and about 5 percent in dry weight basis of said slurry. Preferably, the method of the invention comprises the step of adding a binder to the blend of different tobacco types of between about 1 percent and about 5 percent in dry weight basis of the homogenized tobacco material. In addition to controlling the sizes of the tobacco powder used in the process of the present invention, it is also advantageous to add a binder, such as any of the gums or pectins described herein, to ensure that the tobacco powder remains substantially dispersed throughout the homogenized tobacco web. For a descriptive review of gums, see Gums And Stabilizers For The Food Industry, IRL Press (G. O. Phillip et al. eds. 1988); Whistler, Industrial Gums: Polysaccharides And Their Derivatives, Academic Press (2d ed. 1973); and Lawrence, Natural Gums For Edible Purposes, Noyes Data Corp. (1976).

Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

Preferably, the method comprises adding an aerosol-former to the slurry in an amount comprised between about 5 percent and about 30 percent in dry weight basis of said homogenized tobacco material. Suitable aerosol-formers for inclusion in slurry for webs of homogenised tobacco material are known in the art and include, but are not limited to: monohydric alcohols like menthol, polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

For example, where the homogenized tobacco material according to the specification is intended for use as aerosol-forming substrates in heated aerosol-generating articles, webs of homogenised tobacco material may have an aerosol former or humectant content of between about 5 percent and about 30 percent by weight on a dry weight basis, preferably between about 15 percent and about 20 percent. Homogenized tobacco material intended for use in electrically-operated aerosol-generating system having a heating element may preferably include an aerosol former of greater than about 5 percent to about 30 percent. For homogenized tobacco material intended for use in electrically-operated aerosol-generating system having a heating element, the aerosol former may preferably be glycerol.

Preferably, the method according to the invention comprises the step of adding cellulose fibres to the slurry in an amount between about 1 percent and about 3 percent in dry weight basis of said slurry.

A cellulose pulp includes water and cellulose fibres. Cellulose fibres for including in a slurry for homogenized tobacco material are known in the art and include, but are not limited to: soft-wood fibres, hard wood fibers, jute fibres, flax fibres, tobacco fibres and combination thereof. In addition to pulping, the cellulose fibres might be subjected to suitable processes such as refining, mechanical pulping, chemical pulping, bleaching, sulphate pulping and combination thereof.

Fibres particles may include tobacco stem materials, stalks or other tobacco plant material. Preferably, cellulose-based fibres such as wood fibres comprise a low lignin content. Fibres particles may be selected based on the desire to produce a sufficient tensile strength for the cast leaf. Alternatively fibres, such as vegetable fibres, may be used either with the above fibres or in the alternative, including hemp and bamboo. During the processing from the slurry to a final homogenized tobacco material to be cut and introduced in an aerosol-generating device, homogenized tobacco sheets are often required to withstand wetting, conveying, drying and cutting. The ability of the homogenized tobacco web to withstand the rigors of processing with minimal breakage and defect formation is a highly desirable characteristic since it reduces the loss of tobacco material. The introduction of cellulose fibres in the slurry increases the tensile strength to traction of the web of material, acting as a strengthening agent. Therefore adding cellulose fibres may increase the resilience of the homogenized tobacco material web and thus reduce the manufacturing cost of the aerosol-generating device and other smoking articles.

The density of the slurry, in particular before a step of casting the slurry to form a homogenized tobacco web, is important for determining the end quality of the web itself. A proper slurry density and homogeneity minimizes the number of defects and maximizes tensile strength of the web.

The invention will be further described, by way of example only, with reference to the accompanying drawings in which.

Figure 1:
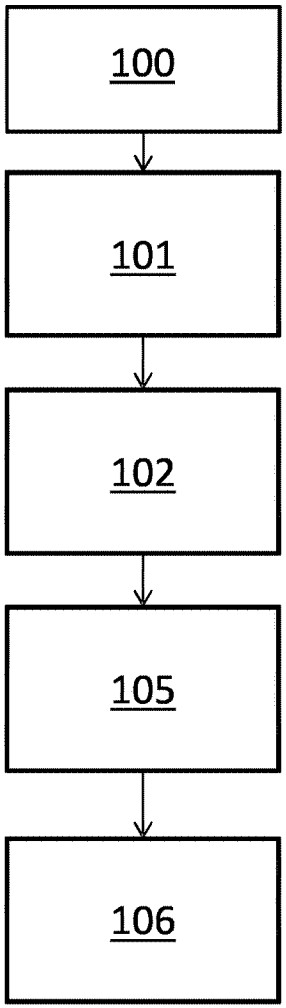
FIG. 1 shows a flow diagram of a method to produce slurry for homogenized tobacco material according to the invention.

With initial reference to FIG. 1, a method for the production of slurry according to the present invention is represented. The first step of the method of the invention is the selection 100 of the tobacco types and tobacco grades to be used in the tobacco blend for producing the homogenized tobacco material. Tobacco types and tobacco grades used in the present method are for example bright tobacco, dark tobacco, aromatic tobacco and filler tobacco.

Only the selected tobacco types and tobacco grades intended to be production of the used for the homogenized tobacco material undergo the processing according to following steps of the method of the invention.

The method includes a further step 101 in which the selected tobacco is laid down. This step may comprise checking the tobacco integrity, such as grade and quantity, which can be for example verified by a bar code reader for product tracking and traceability. After harvesting and curing, the leaf of tobacco is given a grade, which describes for example the stalk position, quality, and colour.

Further, the lay down step 101 might also include, in case the tobacco is shipped to the manufacturing premises for the production of the homogenized tobacco material, de-boxing or case opening of the tobacco boxes. The de-boxed tobacco is then preferably fed to a weighing station in order to weight the same.

Moreover, the tobacco lay down step 101 may include bale slicing, if needed, as the tobacco leaves are normally compressed into bales in shipping boxes for shipping.

The following steps are performed for each tobacco type, as detailed below. These steps may be performed subsequently per grade such that only one production line is required. Alternatively, the different tobacco types may be processed in separate lines. This may be advantageous where the processing steps for some of the tobacco types are different. For example, in conventional primary tobacco processes bright tobaccos and dark tobaccos are processed at least partially in separate processes, as the dark tobacco often receives an additional casing. However, according to the present invention, preferably, no casing is added to the blended tobacco powder before formation of the homogenized tobacco web.

Further, the method of the invention includes a step 102 of coarse grinding of the tobacco leaves.

Figure 2:
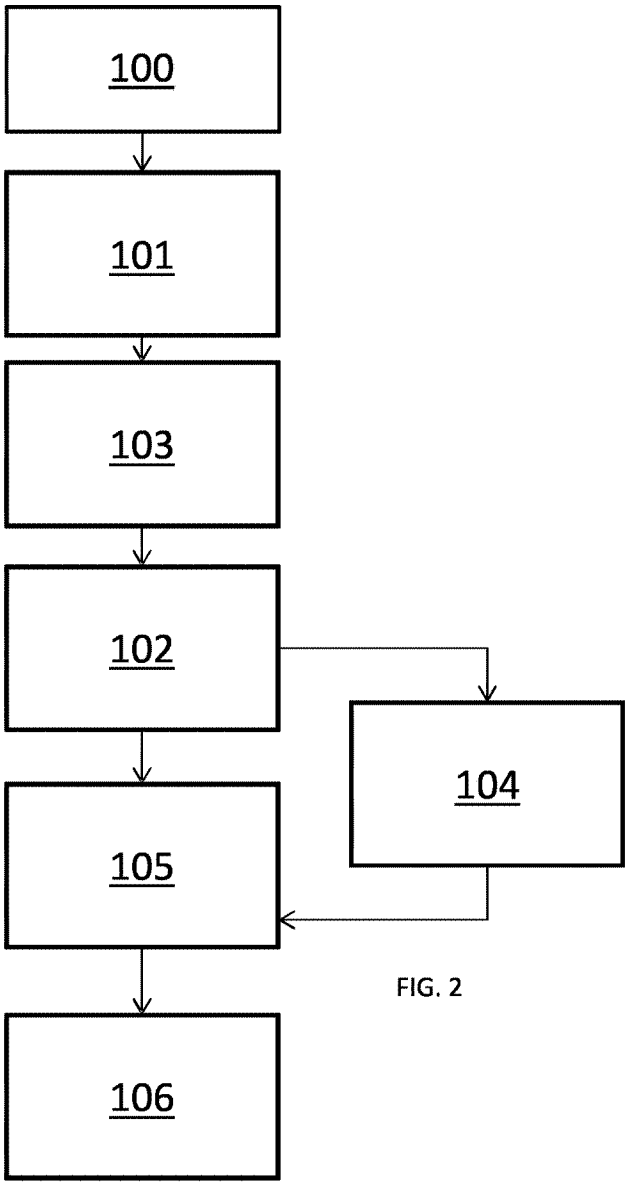
FIG. 2 shows a block diagram of a variant of the method of FIG. 1.

According to a variant of the method of the invention, after the tobacco lay down step 101 and before the tobacco coarse grinding step 102, a further shredding step 103 is performed, as depicted in FIG. 2. In the shredding step 103 the tobacco is shredded into strips having preferably a mean size comprised between about 2 millimetres and about 100 millimetres.

Preferably, after the shredding step 103, a step of removal of non-tobacco material from the strips is performed (not depicted in FIGS. 1 and 2).

Subsequently, the shredded tobacco is transported towards the coarse grinding step 102. The flow rate of tobacco into a mill to coarse grind the strips of tobacco leaf is preferably controlled and measured.

In the coarse grinding step 102, the tobacco strips are preferably reduced to a mean particle size of between about 0.25 millimetres and about 2 millimetres. At this stage, the tobacco particles are still with their cells substantially intact and the resulting particles do not pose relevant transport issues.

The method of the invention may include an optional step 104, depicted in FIG. 2, which includes packing and shipping the coarse grinded tobacco. This step 104 is performed in case the coarse grinding step 102 and the subsequent step of the method of the invention are performed in different manufacturing facilities.

Preferably, after the coarse grinding step 102, the tobacco particles are transported, for example by pneumatic transfer, to a blending step 105. Alternatively, the step of blending 105 could be performed before the step of coarse grinding 102, or where present, before the step of shredding 103, or, alternatively, between the step of shredding 103 and the step of coarse grinding 102.

In the blending step 105, all the coarse ground tobacco particles of the different tobacco types selected for the tobacco blend are blended. The blending step 105 therefore is a single step for all the selected tobacco types. This means that after the step of blending there is only need for a single process line for all of the different tobacco types.

Figure 4:
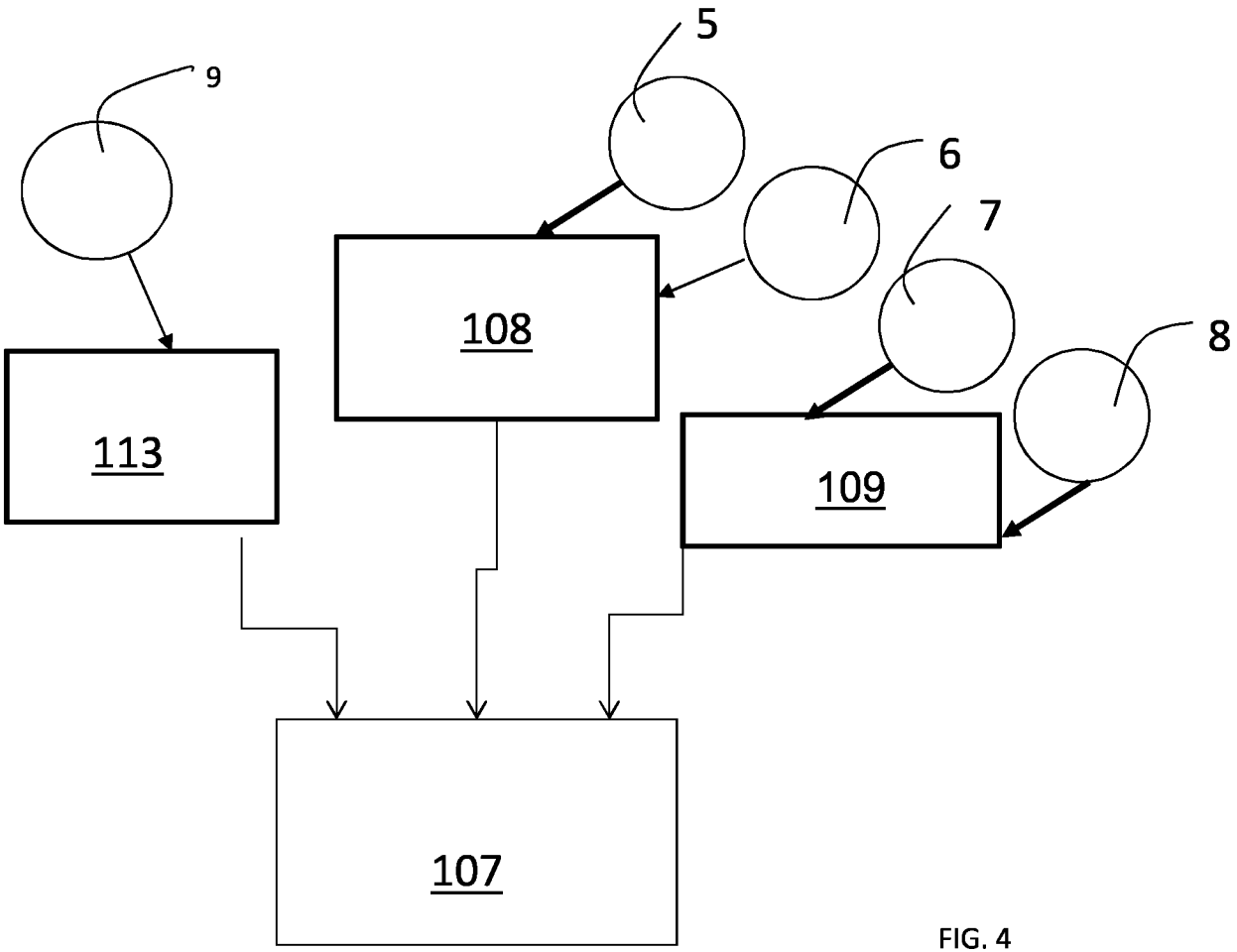
FIG. 4 shows an enlarged view of one of the steps of the method of FIG. 1, 2 or 3.

In the blending step 105, preferably mixing of the various tobacco types in particles is performed. Preferably a step of measuring and controlling one or more of the properties of the tobacco blend is performed. According to the invention, the flow of tobacco may be controlled such that the desired blend is obtained. In FIG. 4, the introduction of the various tobacco types during the blending step 105 is shown.

It is to be understood that each tobacco type could be itself a sub-blend, in other words, the "bright tobacco type" could be for example a blend of Virginia tobacco and Brazil flue-cured tobacco of different grades.

After the blending step 105, a fine grinding step 106, preferably to a tobacco powder mean size of between about 0.03 millimetres and about 0.12 millimetres is performed. This fine grinding step 106 reduces the size of the tobacco down to a powder size suitable for the slurry preparation. After this fine grinding step 106, the cells of the tobacco are at least partially shattered and the tobacco powder may become sticky. The so obtained tobacco powder can be immediately used to form the tobacco slurry. Alternatively, a further step of storage of the tobacco powder, for example in suitable containers may be inserted (not shown).

Figure 3:
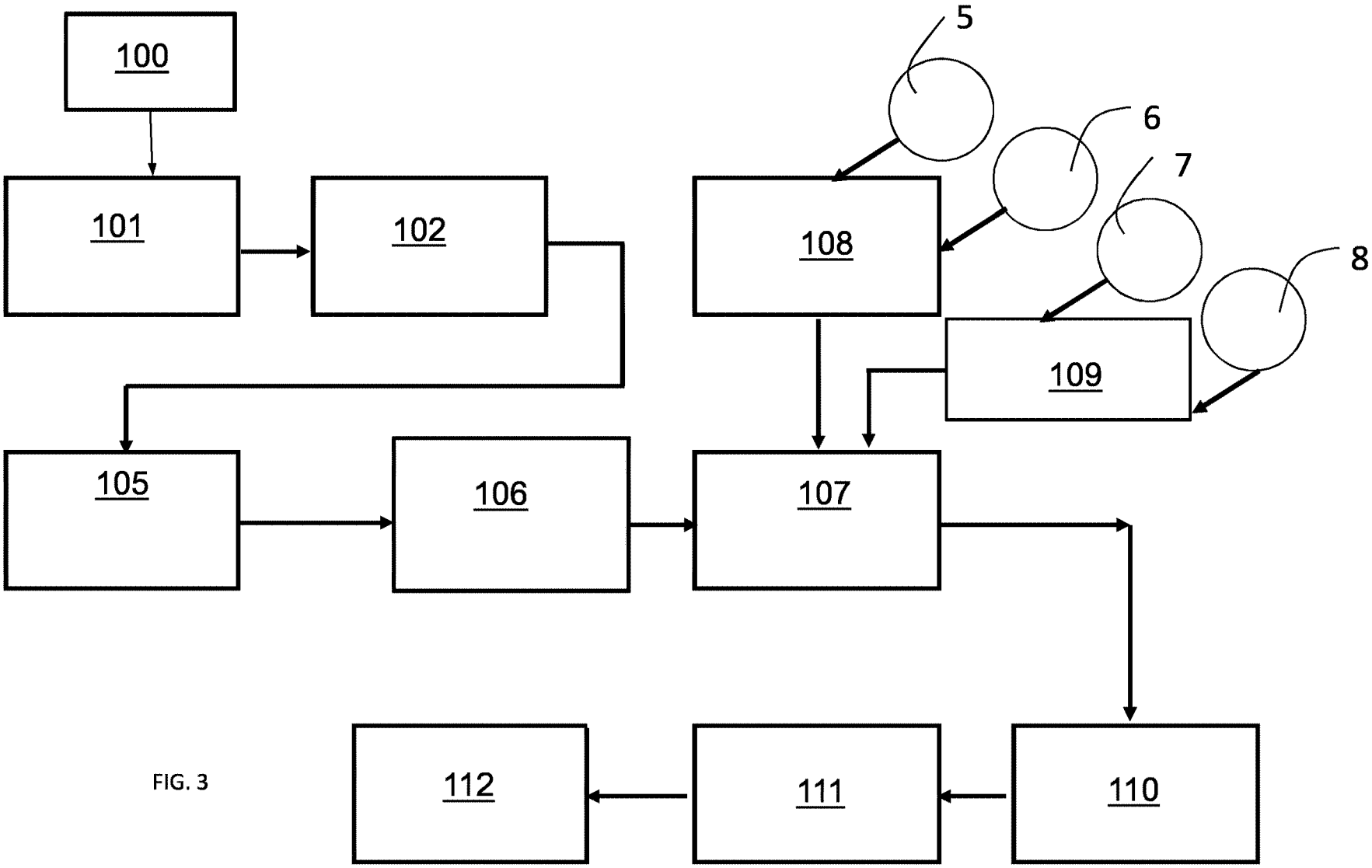
FIG. 3 shows a block diagram of a method for production of a homogenized tobacco material according to the invention.

With reference to FIG. 3, a method of the invention for a manufacture of a homogenized tobacco web is shown. Although only steps 100, 101, 102 and 105 are depicted, the method of FIG. 3 may also include steps 103 and 104. From step 106 of fine grinding, the tobacco powder is used in a subsequent slurry preparation step 107. Prior to or during the slurry preparation step 107, the method of the invention includes two further steps: a pulp preparation step 108 where cellulose fibres 5 and water 6 are pulped to uniformly disperse and refine the fibres in water, and a suspension preparation step 109, where an aerosol-former 7 and a binder 8 are premixed. Preferably, the aerosol-former 7 includes glycerol and the binder 8 includes guar. Advantageously, the suspension preparation step 109 includes premixing guar and glycerol without the introduction of water.

The slurry preparation step 107 preferably comprises transferring the premix solution of the aerosol-former and the binder to a slurry mixing tank and transferring the pulp to the slurry mixing tank. Further, the slurry preparation step comprises dosing the tobacco powder blend into the slurry mixing tank with pulp, and the guar-glycerol suspension. More preferably, this step also includes processing the slurry with a high shear mixer to ensure uniformity and homogeneity of the slurry.

Preferably, the slurry preparation step 107 also includes a step of water addition, where water is added to the slurry to obtain the desired viscosity and moisture.

In order to form the homogenized tobacco web, preferably the slurry formed according to step 107 is cast in a casting step 110. Preferably, this casting step 110 includes transporting the slurry to a casting station and casting the slurry into web having a homogenous and uniform film thickness on a support. Preferably, during casting, the cast web thickness, moisture and density are controlled immediately after casting and more preferably are also continuously monitored and feedback-controlled using slurry measuring devices during the whole process.

During the casting step, a discard step 112 may take place, in which portions of the cast web which may include defects are removed from the remaining of the cast web. The removed portions may be outside specifications. Alternatively, the removed portions of the cast sheet may be not desired.

The homogenized cast web is then dried in a drying step 111 comprising a uniform and gentle drying of the cast web, for example in an endless, stainless steel belt dryer. The endless, stainless steel belt dryer may comprise individually controllable zones. Preferably the drying step comprises monitoring the cast leaf temperature at each drying zone to ensure a gentle drying profile at each drying zone and heating the support where the homogenized cast web is formed. Preferably, the drying profile is a so called TLC drying profile.

A discard step 112 may take place also after or during the drying step, for example if portions of the cast sheets develop defects or become outside specifications.

At the conclusion of the web drying step 111, a monitoring step (not shown) is executed to measure the moisture content and number of defects present in the dried web.

The homogenized tobacco web that has been dried to a target moisture content is then preferably wound up in a winding step (not depicted), for example to form a single master bobbin. This master bobbin may be then used to perform the production of smaller bobbins by slitting and small bobbin forming process. The smaller bobbin may then be used for the production of an aerosol-generating article (not shown).

In the winding step, a further discard step 112 may take place, for example because some portions of the cast web may not fit into the bobbins' width.

In FIG. 3, the discard step 112 is depicted only after the drying step, but as said it can take place during the casting, drying and winding steps.

The portions of discarded web can be introduced in a further slurry production. As depicted in FIG. 4, the step of slurry formation 107 includes also a discarded portions addition step 113, where the discarded portions 9 are introduced into a further batch of slurry production. That is, the same steps 100-106 described with reference to FIGS. 1-3 are repeated in the production of a new batch of slurry, but a step of discarded portion addition 113 is added, during which at least some of the portions 9 of cast sheet which have been discarded during the discard step 112 of one or more previous cast sheet production are added into the new batch of slurry. After steps 107-109, then the casting 110 and drying 111 steps, as well as a new discard step 112 are preferably repeated as well. Therefore, at the end of each cast sheet production, there might be portions 9 of cast sheet which have been discarded. The discarded portions are preferably reintroduced in the next, or in one of the next, slurry production processes according to steps 100-109 and 113.

Figure 5:
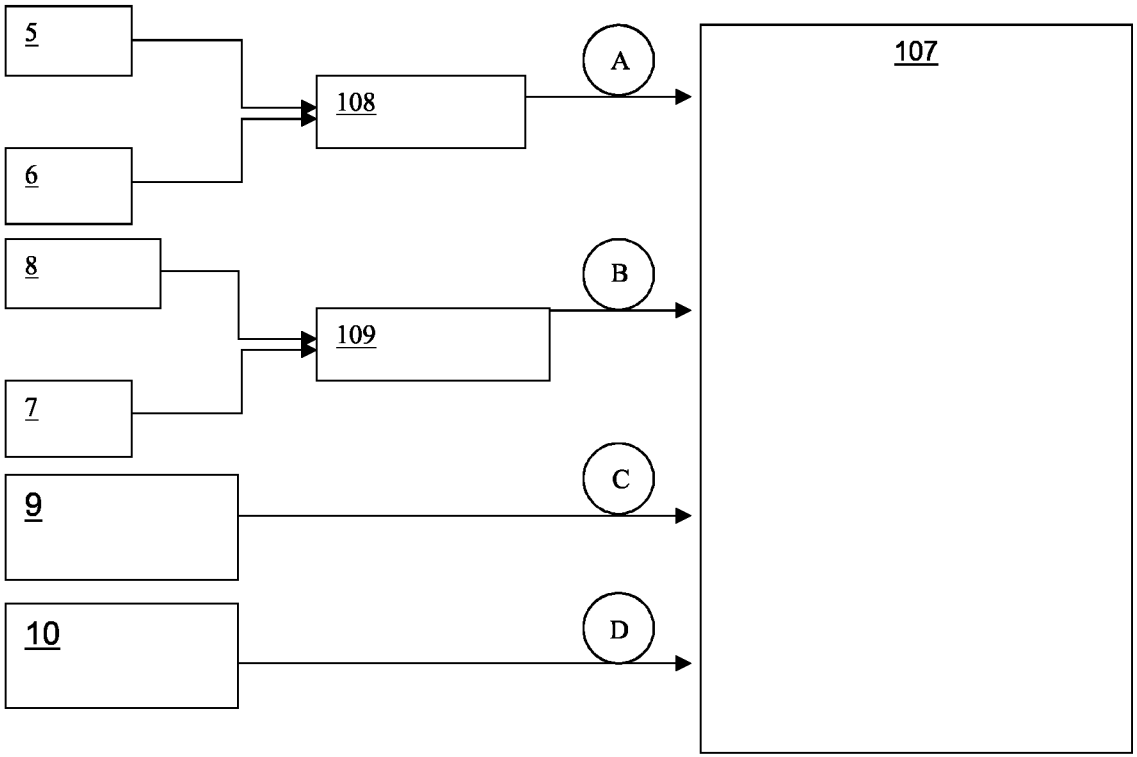
FIG. 5 shows an enlarged view of one of the steps of the method of FIG. 1, 2 or 3.

Preferably, in the production of the slurry 107, the addition of the discarded portions 9 of cast sheet 113 takes place before the addition of tobacco powder into the slurry. That is, preferably the slurry formation has the following temporal sequence: first (step A) the pulp formed in step 108 where cellulose fibres 5 and water 6 which are pulped to uniformly disperse and refine the fibres in water is added, then the suspension prepared in step 109, where the aerosol-former 7 and the binder 8 are premixed, is added (step B), then the discarded portions 9 of cast sheet are added (step C) and as the last element (step D) the tobacco powder 10 is added as well, prepared in the blend of steps 105 and grinding of step 106. This sequence is shown in FIG. 5.

Preferably, before the step of adding the tobacco powder 10 in step D (step 113), mixing of the pulp, of the suspension and of the discarded portions of cast sheet 9 is performed, for example for about 4 minutes.

Preferably, the step 113 of addition of the discarded portions takes place only if the blend of tobacco which has been used to produce the cast sheet from which the discarded portions 9 to be introduced are taken is the same as the blend of tobacco particles 10 formed in step 105 for the production of the new batch of slurry in which the cast tobacco sheet discarded portions 9 are added.

Further, the amount of discarded portions 9 of cast sheet introduced into the slurry is monitored so that it is preferably kept within a desired interval.

Figure 6:
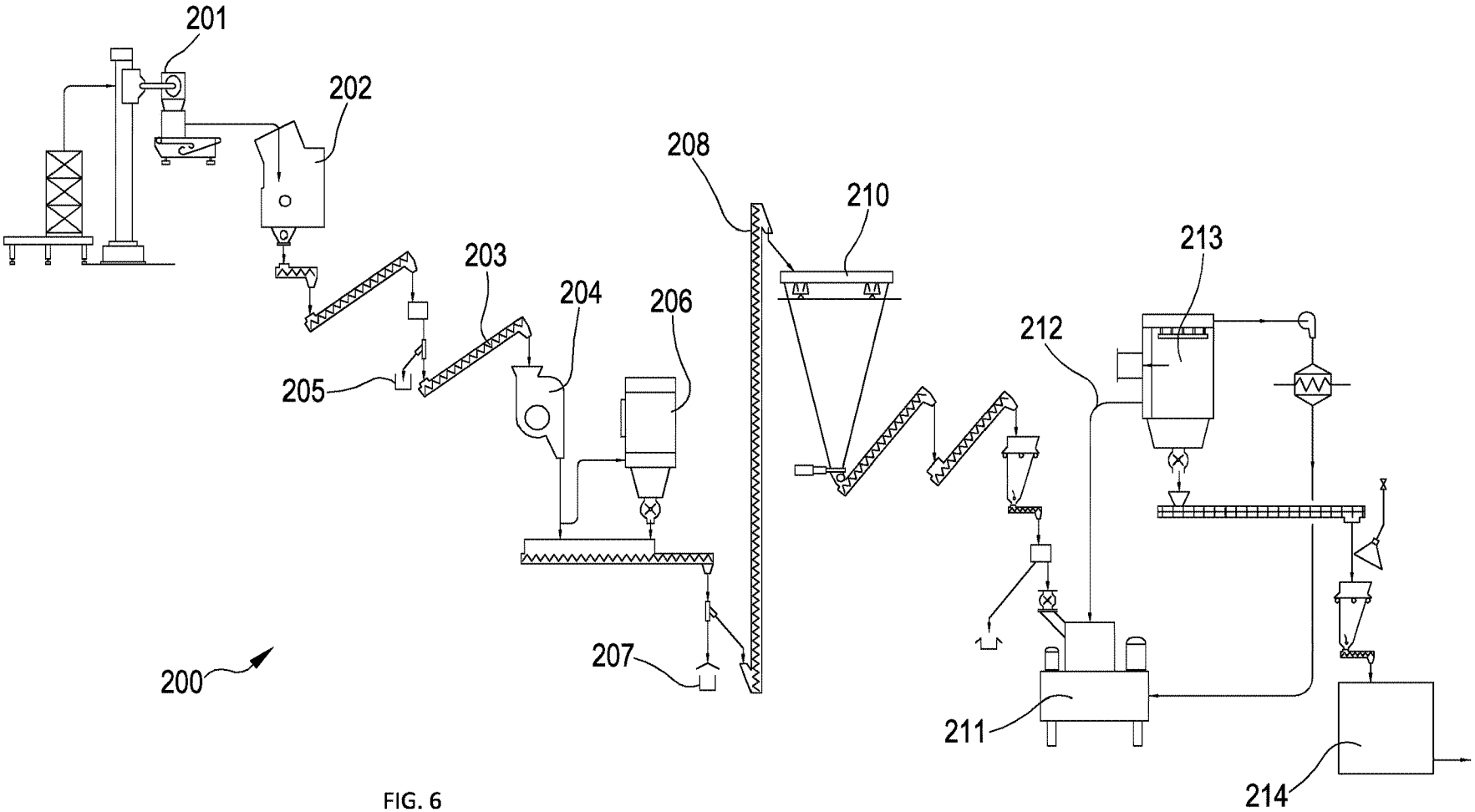
FIG. 6 shows a schematic view of an apparatus for performing the method of FIGS. 1 and 2.

Further, preferably the amount of tobacco present inside the added discarded portions 9 is calculated so that the total amount of tobacco present in the slurry, that is, the total amount including the tobacco powder 10, is within the desired specification The method of production of a slurry for the homogenized tobacco material according to FIG. 1 or 2 is performed using an apparatus for the production of a slurry 200 depicted schematically in FIG. 6. The apparatus 200 includes a tobacco receiving station 201, where accumulating, destacking, weighing and inspecting the different tobacco types takes place. Optionally, in case the tobacco has been shipped into cartons, in the receiving station 201 removal of cartons containing the tobacco is performed. The tobacco receiving station 201 also optionally comprises a tobacco bale splitting unit.

In FIG. 6 only a production line for one type of tobacco is shown, but the same equipment may be present for each tobacco type used in the homogenised tobacco material web according to the invention, depending on when the step of blending is performed. Further the tobacco is introduced in a shredder 202 for the shredding step 103. Shredder 202 can be for example a pin shredder. The shredder 202 is preferably adapted to handle all sizes of bales, to loosen tobacco strips and shred strips into smaller pieces. The shreds of tobacco in each production line are transported, for example by means of pneumatic transport 203, to a mill 204 for the coarse grinding step 102. Preferably a control is made during the transport so as to reject foreign material in the tobacco shreds. For example, along the pneumatic transport of shredded tobacco, a string removal conveyor system, heavy particle separator and metal detector may be present, all indicated with 205 in the appended drawing.

Mill 204 is adapted to coarse grind the tobacco strips up to a size of between about 0.25 millimetres and about 2 millimetres. The rotor speed of the mill can be controlled and changed on the basis of the tobacco shreds flow rate.

Preferably, a buffer silo 206 for uniform mass flow control, is located after the coarse grinder mill 204. Furthermore, preferably mill 204 is equipped with spark detectors and safety shut down system 207 for safety reasons.

From the mill 204, the tobacco particles are transported, for example by means of a pneumatic transport 208, to a blender 210. Blender 210 preferably includes a silo in which an appropriate valve control system is present. In the blender, all tobacco particles of all the different types of tobacco which have been selected for the predetermined blend are introduced. In the blender 210, the tobacco particles are mixed to a uniform blend. From the blender 210, the blend of tobacco particles is transported to a fine grinding station 211.

Fine grinding station 211 is for example an impact classifying mill with suitable designed ancillary equipment to produce fine tobacco powder to the right specifications, that is, to a tobacco powder between about 0.03 millimetres and about 0.12 millimetres. After the fine grinding station 211, a pneumatic transfer line 212 is adapted to transporting the fine tobacco powder to a buffer powder silo 213 for continuous feed to a downstream slurry batch mixing tank where the slurry preparation process takes place. In the slurry batch mixing tank also the discarded portions 9 of cast sheet are introduced.

Figure 7:
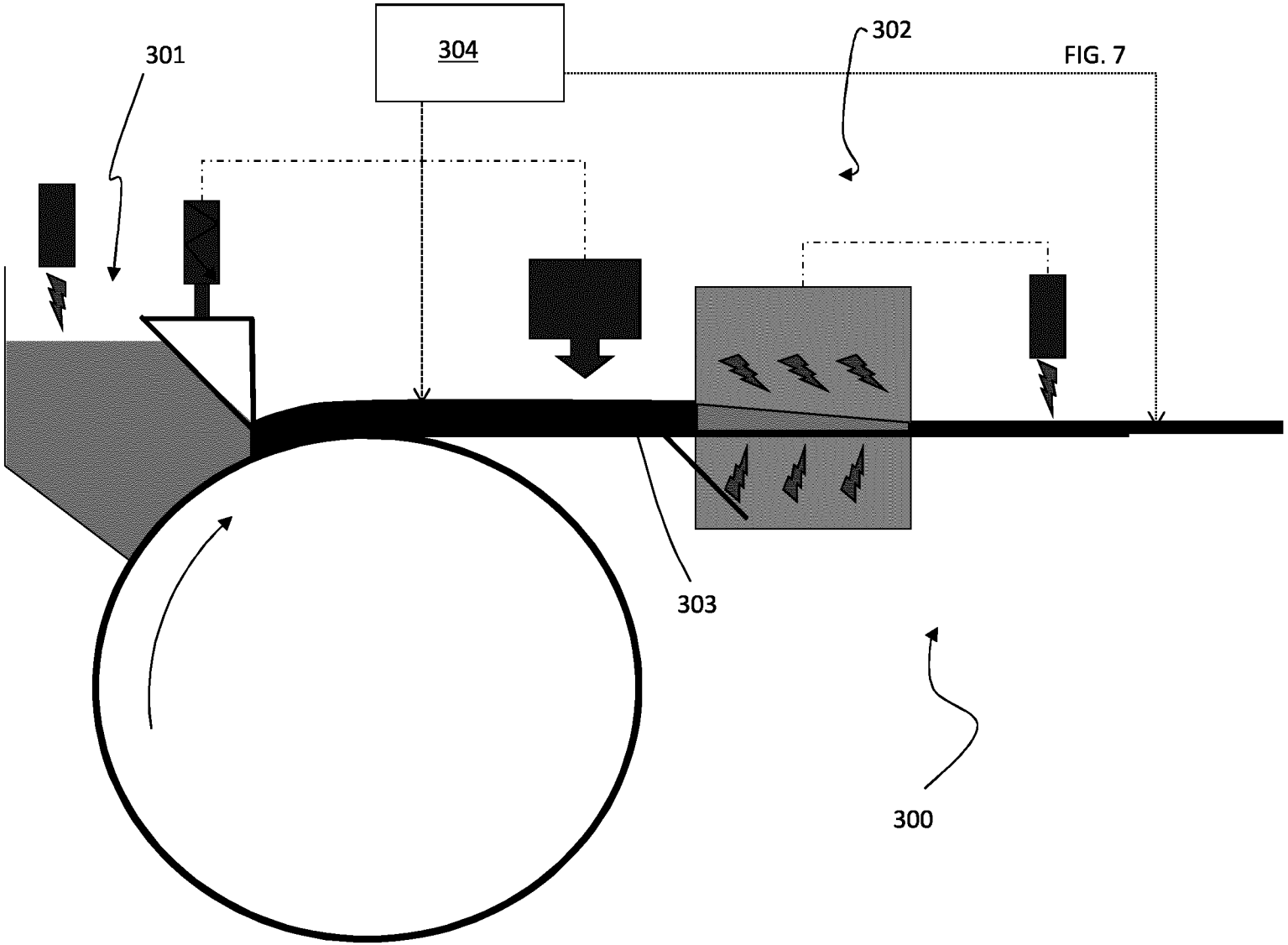
FIG. 7 shows a schematic view of an apparatus for performing the method of FIG. 3.

The slurry which has been prepared using the tobacco powder above described in steps 106, 107 and 108 of the method of the invention is preferably also cast in a casting station 300 as depicted in FIG. 7.

Slurry from a buffer tank (not shown), is transferred by means of suitable pump with precision flow rate control measurement to the casting station 300. Casting station 300 comprises preferably the following sections. A precision slurry casting box and blade assembly 301 where slurry is cast onto a support 303, such as a stainless steel belt with the required uniformity and thickness for proper web formation, receives the slurry from the pump. A main dryer 302, having drying zones or sections is provided to dry the cast tobacco web. Preferably, the individual drying zones have steam heating on the bottom side of the support with heated air above the support and adjustable exhaust air control. Within the main dryer 302 the homogenized tobacco web is dried to desired final moisture on the support 303.

In the casting station 300, discarding means 304 to remove undesired portions of the cast sheet are present. The undesired portions 9 are thus discarded and re-used in the process to produce the slurry, as depicted for example in FIGS. 4 and 5.

The invention claimed is:

1. A method for the preparation of a cast sheet of homogenized tobacco material, said method comprising:
- pulping cellulose fibres with water;
- grinding a blend of tobacco of one or more tobacco types to tobacco particles;
- combining the pulped cellulose fibres with the tobacco particles and with a binder to form a slurry;
- homogenizing the slurry;
- casting the slurry to form a cast sheet of homogenized tobacco material from the slurry;
- discarding undesired portions of the cast sheet; and
- introducing the discarded undesired portions of the cast sheet into the slurry;

wherein the method further comprises:
- selecting a total amount of tobacco to be present in the slurry in dry weight;
- determining an amount of tobacco in dry weight present in the discarded undesired portions of the cast sheet introduced in the slurry; and
- adding an amount of tobacco particles to the slurry in order to reach said selected total amount of tobacco in the slurry when summed to the amount of tobacco present in the discarded undesired portions of the cast sheet already introduced in the slurry.

2. A method for the preparation of a cast sheet of homogenized tobacco material, said method comprising:
- forming a first batch of slurry, said first formation comprising:
  - pulping cellulose fibres with water;
  - grinding a blend of tobacco of one or more tobacco types to tobacco particles;
  - combining the pulped cellulose fibres with the tobacco particles and with a binder to form a slurry;
  - homogenizing the slurry;
- casting the slurry to form a cast sheet of homogenized tobacco material from the slurry;
- discarding undesired portions of the cast sheet; and
- forming a second batch of slurry, said second formation comprising:
  - pulping cellulose fibres with water;
  - grinding a blend of tobacco of one or more tobacco types to tobacco particles;
  - combining the pulped cellulose fibres with the tobacco particles and with a binder to form a slurry;
  - homogenizing the slurry; and
  - introducing the discarded undesired portions of the cast sheet into the slurry;

wherein the method further comprises:
- selecting a total amount of tobacco to be present in the slurry in dry weight;
- determining an amount of tobacco in dry weight present in the discarded undesired portions of the cast sheet introduced in the slurry; and
- adding an amount of tobacco particles to the slurry in order to reach said selected total amount of tobacco in the slurry when summed to the amount of tobacco present in the discarded undesired portions of the cast sheet already introduced in the slurry.

3. The method according to claim 1, wherein the step of introducing the discarded undesired portions of the cast sheet into the slurry takes place before combining the pulped cellulose fibres with the tobacco particles.

4. The method according to claim 3, including mixing the discarded undesired portions of cast sheet with the pulped cellulose fibres before the step of combining the tobacco particles with the pulped cellulose fibres.

5. The method according to claim 1, including the step of:

blending one or more the following tobaccos types:

Bright tobacco;

Dark tobacco;

Aromatic tobacco;

Filler tobacco;

to obtain the blend of tobacco of one or more tobacco types.

6. The method according to claim 1, including the steps of:

combining the binder with an aerosol-former; and adding the combination to the slurry.

7. The method according to claim 1, including the steps of:

pulping cellulose fibres with water and adding the pulped fibres to a tank;

adding the binder to the tank;

adding the tobacco particles to the tank; and adding the discarded undesired portions of the cast sheet into the tank before adding the tobacco particles.

8. The method according to claim 1, wherein the step of introducing the discarded undesired portions of the cast sheet into the slurry takes place only if the blend of tobacco present in said discarded undesired portions of the cast sheet is the same as the blend of tobacco in said tobacco particles.

9. The method according to claim 1, including the step of:

adding the tobacco particles and the discarded undesired portions of the cast sheet into the slurry so as to obtain a total amount of tobacco comprised between about 50 percent and about 93 percent in dry weight basis of slurry.

10. The method according to claim 1, comprising the step of:

adding in the slurry an amount of undesired portions of cast sheet comprised between about 1 percent and about 25 percent in dry weight basis of the slurry.

11. The method according to claim 1, comprising the step of:

drying the cast sheet of homogenized tobacco material.

12. The method according to claim 1, comprising the step of:

adding the binder to the slurry in an amount comprised between about 1 percent and about 5 percent in dry weight basis of said slurry.

13. The method according to claim 1, comprising the step of:

adding an aerosol-former to the slurry in an amount comprised between about 5 percent and about 30 percent in dry weight basis of said homogenized tobacco material.

14. The method according to claim 1, comprising the step of:

adding the cellulose fibres to the slurry in an amount comprised between about 1 percent and about 3 percent in dry weight basis of said slurry.

15. The method according to claim 2, wherein the step of introducing the discarded undesired portions of the cast sheet into the slurry takes place before combining the pulped cellulose fibres with the tobacco particles.

16. The method according to claim 15, including mixing the discarded undesired portions of cast sheet with the pulped cellulose fibres before the step of combining the tobacco particles with the pulped cellulose fibres.

17. The method according to claim 2, including the step of:

blending one or more the following tobaccos types:

Bright tobacco;

Dark tobacco;

Aromatic tobacco;

Filler tobacco;

to obtain the blend of tobacco of one or more tobacco types.

18. The method according to claim 2, including the steps of:

combining the binder with an aerosol-former; and adding the combination to the slurry.

19. The method according to claim 2, including the steps of:

pulping cellulose fibres with water and adding the pulped fibres to a tank;

adding the binder to the tank;

adding the tobacco particles to the tank; and adding the discarded undesired portions of the cast sheet into the tank before adding the tobacco particles.

20. The method according to claim 2, wherein the step of introducing the discarded undesired portions of the cast sheet into the slurry takes place only if the blend of tobacco present in said discarded undesired portions of the cast sheet is the same as the blend of tobacco in said tobacco particles.

21. The method according to claim 2, including the step of:

adding the tobacco particles and the discarded undesired portions of the cast sheet into the slurry so as to obtain a total amount of tobacco comprised between about 50 percent and about 93 percent in dry weight basis of slurry.

22. The method according to claim 2, comprising the step of:

adding in the slurry an amount of undesired portions of cast sheet comprised between about 1 percent and about 25 percent in dry weight basis of the slurry.

23. The method according to claim 2, comprising the step of:

drying the cast sheet of homogenized tobacco material.

24. The method according to claim 2, comprising the step of:

adding the binder to the slurry in an amount comprised between about 1 percent and about 5 percent in dry weight basis of said slurry.

25. The method according to claim 2, comprising the step of:

adding an aerosol-former to the slurry in an amount comprised between about 5 percent and about 30 percent in dry weight basis of said homogenized tobacco material.

26. The method according to claim 2, comprising the step of:

adding the cellulose fibres to the slurry in an amount comprised between about 1 percent and about 3 percent in dry weight basis of said slurry.

* * * * *